US010669805B1

(12) United States Patent
Clay et al.

(10) Patent No.: US 10,669,805 B1
(45) Date of Patent: Jun. 2, 2020

(54) ADAPTOR FOR ELECTRONIC SUBMERSIBLE PUMP

(71) Applicant: OIL STATES INDUSTRIES, INC., Arlington, TX (US)

(72) Inventors: Tom Clay, Edmond, OK (US); Paul Kalivas, Edmond, OK (US); Barrett Hartman, Choctaw, OK (US)

(73) Assignee: OIL STATES INDUSTRIES, INC., Arlington, TX (US)

( * ) Notice: Subject to any disclaimer, the term of this patent is extended or adjusted under 35 U.S.C. 154(b) by 0 days.

(21) Appl. No.: 16/290,583

(22) Filed: Mar. 1, 2019

(51) Int. Cl.

| | |
|---|---|
| ***E21B 21/10*** | (2006.01) |
| ***E21B 33/068*** | (2006.01) |
| ***E21B 33/076*** | (2006.01) |
| ***E21B 34/02*** | (2006.01) |
| ***E21B 34/04*** | (2006.01) |
| *E21B 47/10* | (2012.01) |
| *E21B 34/00* | (2006.01) |
| *E21B 43/12* | (2006.01) |

(52) U.S. Cl.
CPC ..... *E21B 33/076* (2013.01); *E21B 21/106* (2013.01); *E21B 34/02* (2013.01); *E21B 43/126* (2013.01); *E21B 47/1025* (2013.01); *E21B 2034/002* (2013.01)

(58) Field of Classification Search
CPC .... E21B 21/106; E21B 33/068; E21B 33/072; E21B 33/076; E21B 34/02; E21B 34/04; E21B 43/128
See application file for complete search history.

(56) References Cited

U.S. PATENT DOCUMENTS

| | | | | |
|---|---|---|---|---|
| 4,154,302 | A * | 5/1979 | Cugini | E21B 33/0407 166/378 |
| 4,703,807 | A | 11/1987 | Weston | |
| 5,794,693 | A * | 8/1998 | Wright | E21B 33/047 166/75.14 |
| 6,457,530 | B1 * | 10/2002 | Lam | E21B 33/068 166/242.5 |
| 6,688,386 | B2 * | 2/2004 | Cornelssen | E21B 33/0407 166/65.1 |
| 7,163,064 | B2 | 1/2007 | Moncus et al. | |
| 7,275,591 | B2 | 10/2007 | Allen et al. | |
| 8,567,489 | B2 * | 10/2013 | Vanderford | E21B 33/03 166/75.11 |
| 8,573,294 | B2 * | 11/2013 | Struthers | E21B 17/025 166/379 |
| 9,273,530 | B2 * | 3/2016 | Vanderford | E21B 33/03 |
| 9,388,654 | B2 * | 7/2016 | Urrego Lopera | E21B 33/0385 |
| 9,702,212 | B2 * | 7/2017 | Breda | E21B 33/035 |

(Continued)

*Primary Examiner* — Matthew R Buck
(74) *Attorney, Agent, or Firm* — Polsinelli PC

(57) ABSTRACT

An adaptor is provided for a system including an electronic submersible pump. The adaptor includes a body including an upper surface and a lower surface opposite the lower surface. The body forms an adaptor passage and a channel. The adaptor passage extends along a vertical axis between the upper surface and the lower surface. The channel extends between the upper surface and the lower surface and is operable to receive a cable coupled with the electronic submersible pump. The channel extends in a direction that forms an angle relative to the vertical axis. The upper surface is operable to receive a valve assembly forming a valve passage that aligns with the adaptor passage.

15 Claims, 8 Drawing Sheets

(56) References Cited

U.S. PATENT DOCUMENTS

| | | | | |
|---|---|---|---|---|
| 9,890,607 | B2 * | 2/2018 | Hanlin | E21B 33/0407 |
| 9,896,897 | B2 * | 2/2018 | Brown | E21B 33/043 |
| 2002/0070030 | A1 * | 6/2002 | Smith | E21B 33/0407 166/379 |
| 2007/0125531 | A1 | 6/2007 | Dallas et al. | |
| 2007/0144743 | A1 * | 6/2007 | White | C07D 263/48 166/368 |
| 2007/0209724 | A1 | 9/2007 | Williams et al. | |
| 2015/0315869 | A1 | 11/2015 | Landry | |
| 2015/0330194 | A1 * | 11/2015 | June | E21B 17/003 166/351 |
| 2018/0148989 | A1 * | 5/2018 | Ross | E21B 33/0407 |
| 2018/0202254 | A1 | 7/2018 | McAdam et al. | |
| 2018/0209236 | A1 | 7/2018 | Talgo Morten et al. | |

* cited by examiner

ADAPTOR FOR ELECTRONIC SUBMERSIBLE PUMP

FIELD

The present disclosure relates generally to adaptors for electronic submersible pumps. In at least one example, the present disclosure relates to adaptors for valve assemblies connected to an electronic submersible pump.

BACKGROUND

Electronic submersible pumps (ESPs) can be disposed down a wellbore to pump fluids from the wellbore to the surface. ESPs can be disposed down the wellbore by a conduit which can transport the pumped fluid uphole. Additionally, ESPs are connected to a controller by a cable to communicate instructions, measurements, and/or power.

BRIEF DESCRIPTION OF THE DRAWINGS

Implementations of the present technology will now be described, by way of example only, with reference to the attached figures, wherein.

and

Figure 5:
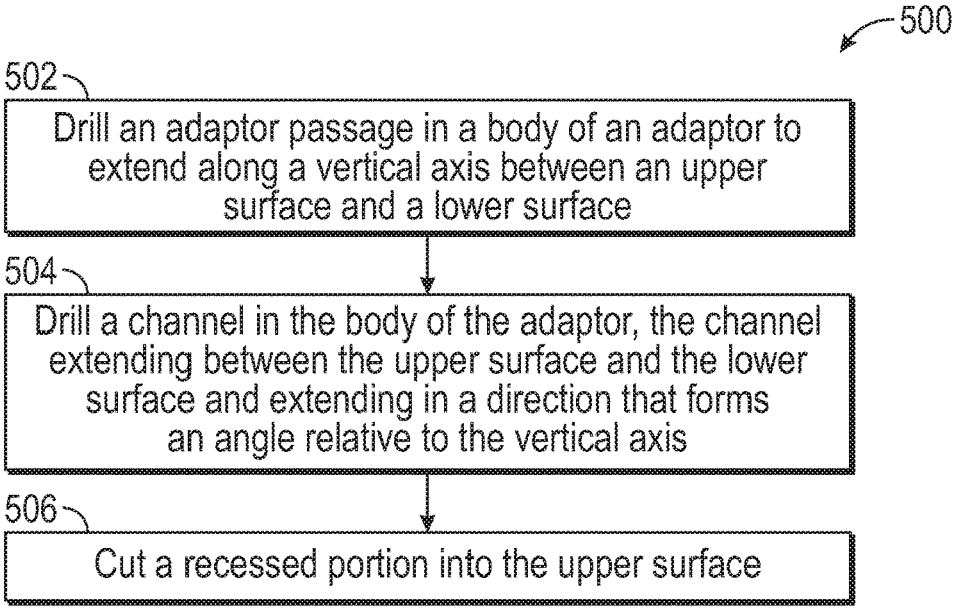

FIG. 5 is a flow chart of a method for manufacturing an exemplary adaptor.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the examples described herein. However, it will be understood by those of ordinary skill in the art that the examples described herein can be practiced without these specific details. In other instances, methods, procedures and components have not been described in detail so as not to obscure the related relevant feature being described. Also, the description is not to be considered as limiting the scope of the examples described herein. The drawings are not necessarily to scale and the proportions of certain parts may be exaggerated to better illustrate details and features of the present disclosure.

Several definitions that apply throughout this disclosure will now be presented. The term "coupled" is defined as connected, whether directly or indirectly through intervening components, and is not necessarily limited to physical connections. The term "communicatively coupled" is defined as connected, either directly or indirectly through intervening components, and the connections are not necessarily limited to physical connections, but are connections that accommodate the transfer of data between the so-described components. The connection can be such that the objects are permanently connected or releasably connected. The term "outside" refers to a region that is beyond the outermost confines of a physical object. The terms "comprising," "including" and "having" are used interchangeably in this disclosure. The terms "comprising," "including" and "having" mean to include, but not necessarily be limited to the things so described.

Disclosed herein is an adaptor for a system including an electronic submersible pump. Electronic submersible pumps (ESPs) need to receive power and/or transmit data through the use of a cable. Conventionally, gooseneck adaptors are used in wellheads to connect ring type joints (RTJ) with valves, for example in trees. The conventional gooseneck adaptors can be, for example 18 inches tall to provide space for the cabling from the ESP disposed downhole. The adaptor provided herein includes an adaptor passage and a channel. The adaptor passage extends along a vertical axis between an upper surface and a lower surface of the adaptor. The adaptor passage provides for fluid to flow through the adaptor between the RTJ and the valves.

The channel extends between the upper and the lower surface of the body of the adaptor and is operable to receive the cable coupled with the ESP. However, instead of providing an elongated gooseneck for the passage to accommodate for the cable, the channel described herein extends in a direction that forms an angle relative to the vertical axis. The angle relative to the vertical axis can be, for example, between about 40 degrees and about 70 degrees. In at least one example, the angle relative to the vertical axis can be between about 50 degrees and about 60 degrees. In at least one example, the angle relative to the vertical axis can be about 55 degrees.

The upper surface of the adaptor can form a recessed portion to receive a valve assembly. The valve assembly forms a valve passage that aligns and is in fluid communication with the adaptor passage. The recessed portion has a bottom recess surface that is substantially perpendicular to the vertical axis. In other examples, the upper surface does not form a recessed portion.

The adaptor can then have a height of about four inches to about eight inches. Additionally, a combination of the valve assembly coupled with the adaptor can then be only about 13 inches to about 18 inches. Accordingly, the overall height of the system is decreased, providing for safer and more convenient access to components of the wellhead and/or tree.

Figure 1A:
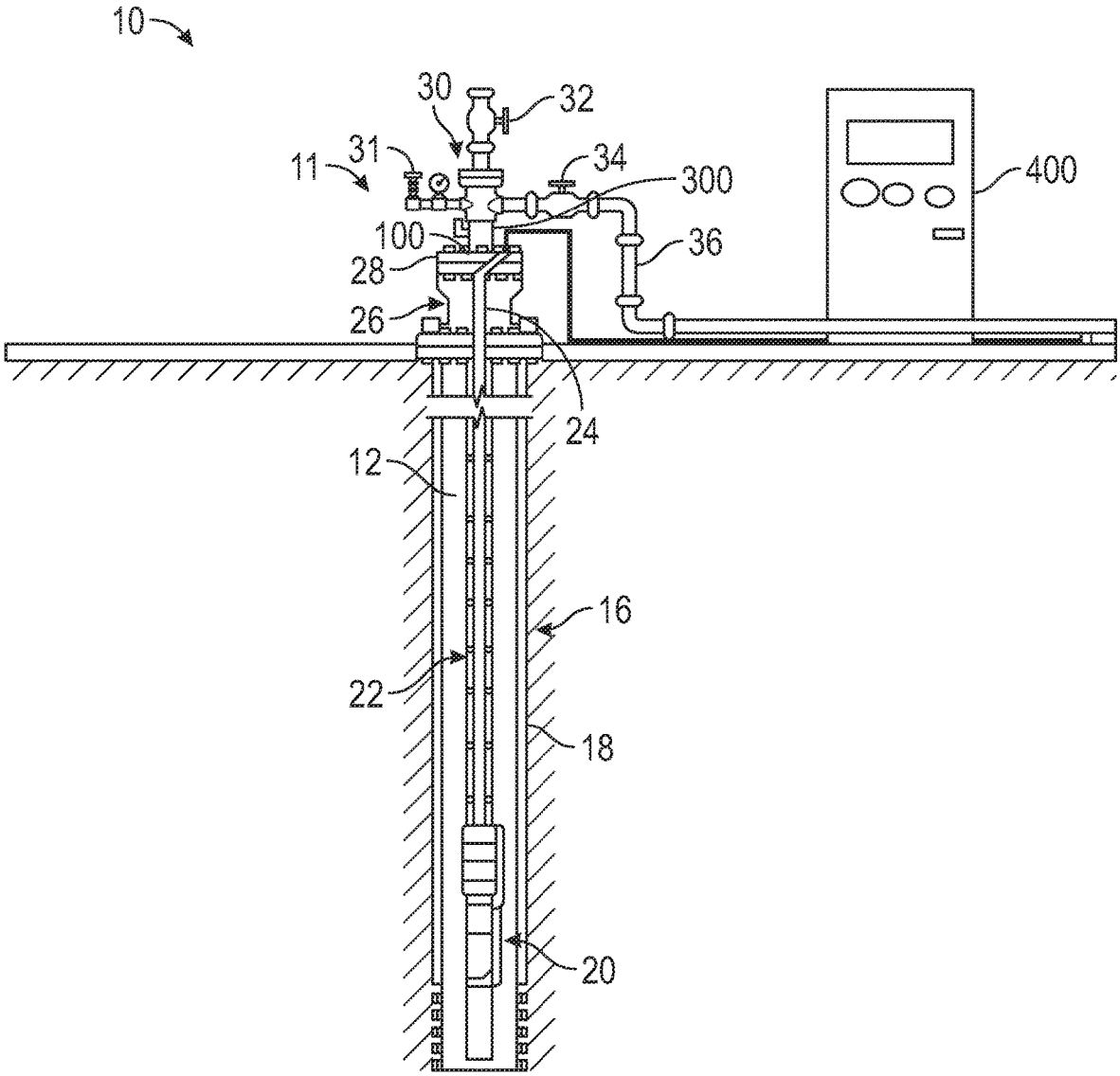
FIG. 1A is a diagram illustrating an exemplary environment for an electronic submersible pump according to the present disclosure.

The adaptor can be employed in an exemplary wellbore system 10 shown, for example, in FIG. 1A. A system 10 for utilizing an electronic submersible pump (ESP) in a wellbore includes a wellhead 11 extending over and/or around a wellbore 12. The wellbore 12 is within an earth formation 16 and, in some examples, can have a casing 18 lining the wellbore 12. In at least one example, the casing 18 can be held in place by cement. An ESP 20 can be moved down the wellbore 12 via a conduit 22 to a desired location. A conduit 22 can be, for example, tubing-conveyed, wireline, slickline, work string, coiled tubing, or any other suitable means for conveying ESPs 20 into a wellbore 12. Once the ESP 20 reaches the desired location, the ESP 20 may pump fluid uphole through the conduit 22 towards the surface and the wellhead 11.

The ESP 20 can pump a variety of fluids, for example production fluids such as crude oil and brine, liquid petroleum products, disposal or injection fluids, fluids containing free gas, solids or contaminates, gases such as $CO_2$ and $H_2S$ gases, and/or treatment chemicals. The fluid can pass from the conduit 22, through the wellhead 11, and to a flow line 36. The flow line 36 can direct the fluid, for example to a processing facility, storage facility, refinery, and/or distribution center.

Figure 1B:
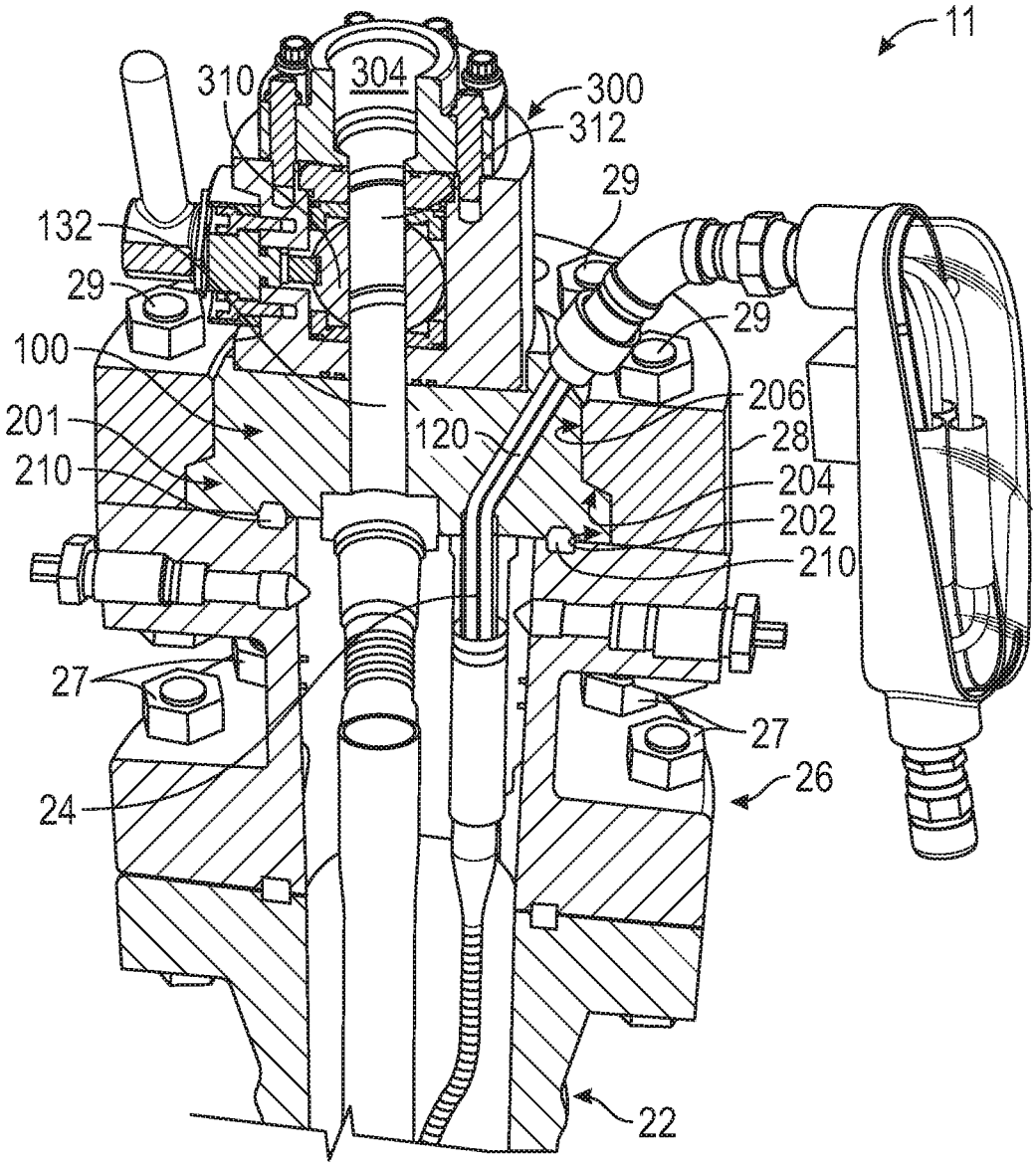
FIG. 1B is an enlarged, cross-sectional view of a wellhead with an adaptor.

The wellhead 11 can include a joint 26. In at least one example, the joint 26 is a ring type joint. The joint 26 can be coupled with the conduit 22, for example by nuts and bolts, screws, or any other suitable coupling mechanism. As illustrated in FIG. 1B, the hub ring 28 is coupled with the joint 26 by nuts and bolts. In other examples, the hub ring 28 can be coupled with the joint 26 by coupling mechanisms such as screws, snap fit, force fit, and/or any other suitable coupling mechanism. As illustrated in FIG. 1B, an adaptor 100 can be coupled with the hub ring 28 by abutment of surfaces. In other examples, the adaptor 100 can be coupled with the hub ring 28 by coupling mechanisms such as nuts and bolts, screws, snap fit, force fit, and/or any other suitable coupling mechanism. The adaptor 100 permits coupling of the hub ring 28 and the joint 26 with a valve assembly 300. The valve assembly 300 can control fluid from flowing to a tree 30. In other examples, a tree 30 may not be included, and the valve assembly 300 can control fluid flow directly to a flow line 36. In the open configuration, the valve assembly 300 can permit fluid to flow across the valve assembly 300, for example into the flow line 36. In the closed configuration, the valve assembly 300 can at least restrict, or in some examples prevent, flow across the valve assembly 300. For example, in the closed configuration, fluid is prevented from flowing across the valve assembly 300 into the flow line 36.

In at least one example, as illustrated in FIG. 1A, the tree 30 can be installed and coupled with the wellhead 11. The tree 30 can regulate the flow of fluid from the wellbore 12. As illustrated in FIG. 1A, the tree 30 can include a kill wing valve 31, a swab valve 32, and/or a production wing valve 34. The kill wing valve 31 can be utilized to control injection of fluids such as corrosion inhibitors or methanol to prevent hydrate formation. The swab valve 32 can be utilized to control the passage of well interventions such as wireline and coiled tubing into the wellbore 12. The production wing valve 34 can be utilized to control the flow of fluids to and/or from the wellbore, for example hydrocarbons to production facilities. The production wing valve 34 can be coupled with a flow line 36, such as a pipeline.

A cable 24 is coupled with the ESP 20 and runs from the surface to the ESP 20 disposed downhole in the wellbore 12. The cable 24 connects the ESP 20 with a controller 400. In at least one example, the controller 400 can provide power to the ESP 20 by the cable 24. In at least one example, the controller 400 can provide instructions to the ESP 20 by the cable 24, for example to begin and/or stop pumping. In some examples, the controller 400 can receive data signals from the ESP 20, for example measurements from sensors. An example of the controller 400 is discussed in further detail for FIG. 4.

It should be noted that while FIG. 1A generally depicts a land-based operation, those skilled in the art would readily recognize that the principles described herein are equally applicable to operations that employ floating or sea-based platforms and rigs, without departing from the scope of the disclosure. Also, even though FIG. 1A depicts a vertical wellbore, the present disclosure is equally well-suited for use in wellbores having other orientations, including horizontal wellbores, slanted wellbores, multilateral wellbores or the like. Further, the wellbore system 10 can have a casing already implemented while, in other examples, the system 10 can also be used in open hole applications.

FIG. 1B illustrates an enlarged, cross-sectional view of the wellhead 11. As illustrated in FIG. 1B, the conduit 22 is coupled with the joint 26 by fasteners 27, for example nuts and bolts, screws, and/or any other suitable fasteners. In at least one example, the conduit 22 is removably coupled with the joint 26.

The joint 26 is coupled with the hub ring 28 by fasteners 29, for example nuts and bolts, screws, and/or by threaded engagement. In some examples, a plurality of fasteners 29 is positioned around the perimeter of the hub ring 28. In at least one example, the joint 26 is removably coupled with the hub ring 28. As illustrated in FIG. 1B, the hub ring 28 is substantially cylindrical. In other examples, the hub ring 28 can be other shapes, such as rectangular prism, ovoid, and/or any other suitable shape.

As illustrated in FIG. 1B, the hub ring 28 forms an opening 201 in which the adaptor 100 can be received. In other examples, the hub ring 28 does not include an opening 201 and is coupled with the adaptor 100. In yet other examples, the adaptor 100 is directly coupled with the joint 26, and the wellhead 11 may not include a hub ring 28. The hub ring 28 includes an inside wall 206 that forms the opening 201. As illustrated in FIG. 1B, the inside wall 206 can be substantially vertical. In other examples, the inside wall 206 can be angled and/or be irregularly shaped. The inside wall 206 forms a notch 202. The notch 202 is operable to receive a protrusion 102 (shown in FIGS. 2A-2C) of the adaptor 100 to couple the adaptor 100 with the hub ring 28. Accordingly, the adaptor 100 can be retained within the hub ring 28, as the protrusion 102 of the adaptor 100, when received in the notch 202 of the hub ring 28, restricts the vertical movement of the adaptor 100, and the adaptor 100 cannot be released from the wellhead 11 without removing the hub ring 28. As illustrated in FIG. 1B, the notch 202 is positioned proximate the bottom of the hub ring 28. While FIG. 1B illustrates the hub ring 28 forming the notch 202 proximate the bottom of the hub ring 28, the notch 202 can be positioned at any suitable height and/or location within the hub ring 28. An angled edge 204 is formed between the notch 202 and the inside wall 206. In some examples, the angled edge 204 can be substantially horizontal. In some examples, the angled edge 204 can be curved. In some examples, the angled edge 204 can be substantially linear. In yet some examples, only a portion of the inside wall 206 forms the angled edge 204 and the notch 202.

The adaptor 100 forms an adaptor passage 132 which, received in the opening 201 of the hub ring 28 as illustrated in FIG. 1B, is in fluid communication with the conduit 22. Additionally, when the valve assembly 300 is coupled with the adaptor 100, the adaptor passage 132 is also in fluid communication with a valve passage 304, through which fluid can pass across the valve assembly 300, for example to a tree 30 and/or a flow line 36. Accordingly, the adaptor passage 132 permits fluid to pass from the conduit 22, through the adaptor passage 132, and to the valve passage 304 in the valve assembly 300. A seal ring 210 can be positioned between the bottom of the adaptor 100 and the joint 28. The seal ring 210 can prevent fluid from flowing across the seal ring 210 such that fluid does not leak through any potential gaps between the adaptor 100 and the ring 28.

In some examples, the seal ring 210 may be positioned external the adaptor 100 and the ring 28. In at least one example, the seal ring 210 may be substantially circular. In other examples, seal ring 210 may be rectangular, triangular, oval, or any other suitable shape to create a seal between the adaptor 100 and the ring 28.

The valve assembly 300 can be coupled with the adaptor 100 such that the valve passage 304 is in fluid communication with the adaptor passage 132. As illustrated in FIG. 1B, the valve passage 304 and the adaptor passage 132 may be substantially vertically aligned.

A valve 310 is positioned valve assembly 300 such that the valve 310 can transition between an open configuration to permit fluid communication across the valve 310 and a closed configuration to prevent fluid communication across the valve 310. For example, as illustrated in FIG. 1B, the valve assembly 300 is a ball valve assembly including a ball functioning as the valve 310. The ball 310 can be positioned within a cavity of the valve assembly 300. The ball 310 can form a flow passage 312 which spans across the ball 310. The ball 310 can be rotated within the cavity of the valve assembly 300 between an open configuration and a closed configuration. For example, a handle can be rotated or changed in position, and the ball 310 can be rotated to align the flow passage 312 with the valve passage 304 or rotated such that the flow passage 312 is not aligned with the valve passage 304. When the ball 310 is in the open configuration, the flow passage 312 is aligned with the valve passage 304 to permit fluid communication across the ball 310. When the ball 310 is in the closed configuration, the flow passage 312 is not aligned with the valve passage 304, and fluid communication across the ball 310 is prevented. When the ball 310 is in the closed configuration, an external surface of the ball 310 blocks the valve passage 304, and the fluid is prevented from flowing across the ball 310. In other examples, other types of valves 310 can be utilized, for example check valves, butterfly valves, gate valves, globe valves, plug valves, and/or any other suitable types of valves.

In at least one example, for example as illustrated in FIG. 1B, one or more seals 350 can be positioned between the valve assembly 300 and the adaptor 100. The seals 350 can be, for example, o-ring seals. The seals 350 can prevent fluid from flowing across the seals 350 such that fluid does not leak through any potential gaps between the adaptor 100 and the valve assembly 300. In some examples, the seals 350 may be positioned external the adaptor 100 and the valve assembly 300. In at least one example, the seals 350 may be substantially circular. In other examples, seals 350 may be rectangular, triangular, oval, or any other suitable shape to create a seal between the adaptor 100 and the valve assembly 300.

Figure 2A:
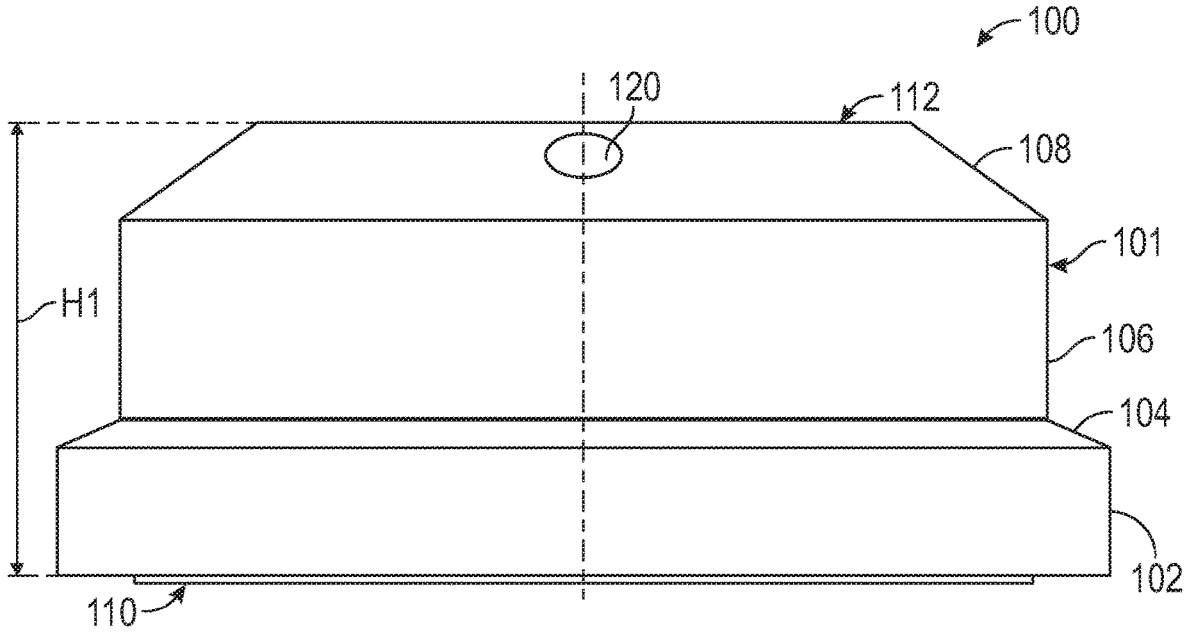
FIG. 2A is a side elevational view of an exemplary adaptor.
Figure 2B:
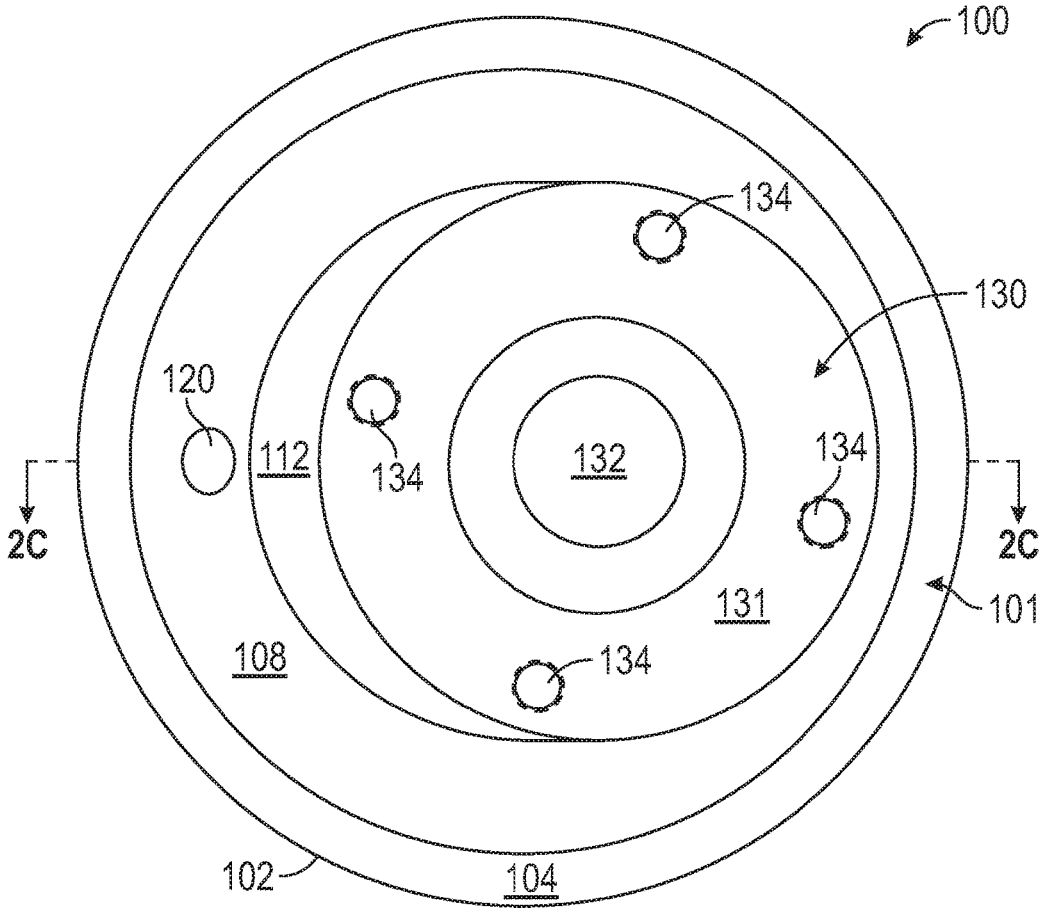
FIG. 2B is a top view of the exemplary adaptor of FIG. 2A.
Figure 2C:
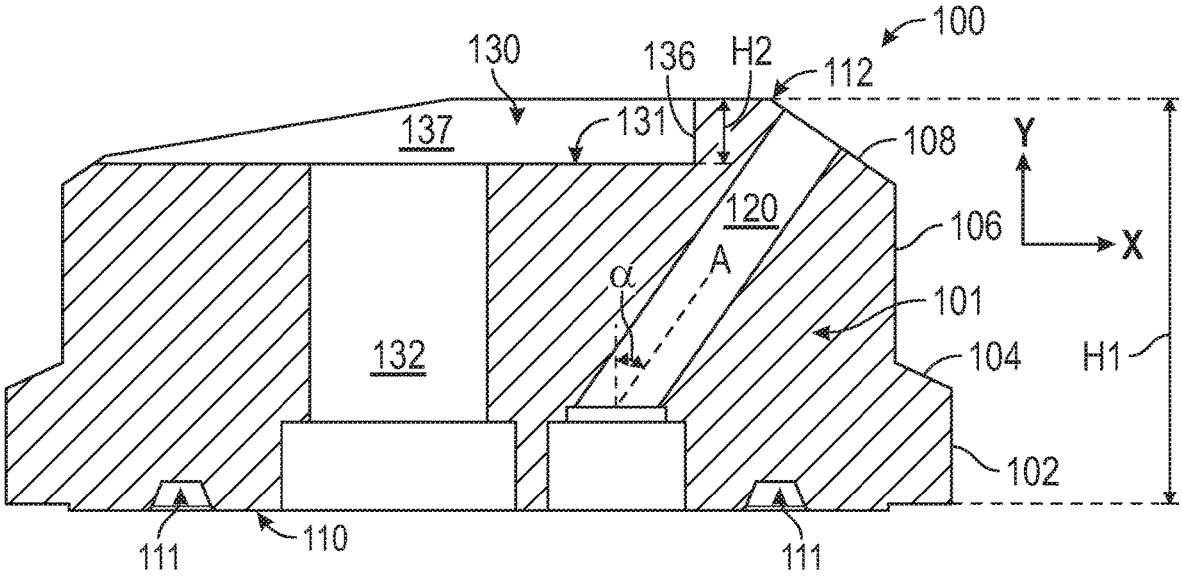
FIG. 2C is a cross-sectional view of the exemplary adaptor of FIG. 2B taken along line 2C-2C.

FIGS. 2A-2C illustrate an exemplary adaptor 100. FIG. 2A illustrates a side elevational view of the adaptor 100; FIG. 2B illustrates a top view of the adaptor 100; and FIG. 2C illustrates a cross-sectional view of the adaptor 100.

The adaptor 100 includes a body 101. In at least one example, the body 101 can include a metallic material. In at least one example, the metallic material of the body 101 can include steel. In other examples, any suitable materials such as metallic alloys, stainless steel, and/or corrosion resistant materials can be included in the metallic material such that the body 101 can withstand the environment, fluids, and pressures associated with the wellhead 11. In at least one example, the body 101 can be one piece of a metallic material. For example, the body 101 can be formed from one single block or cylinder of a metallic material. Accordingly, the body 101 does not include joints or seams and is structurally capable of withstanding any applicable forces. Additionally, the body 101 can be easily manufactured by simple machining techniques as will be discussed in further detail below.

As shown in FIGS. 2A and 2C, the body 101 includes an upper surface 112 and a lower surface 110 opposite the upper surface 112. The body 101 extends along a vertical axis Y, and the upper surface 112 and the lower surface 110 are transverse to the vertical axis Y. As illustrated in FIGS. 2A-2C, the body 101 can be substantially cylindrical. In other examples, the body 101 can be other suitable shapes such as rectangular, hexagonal, octagonal, or any other suitable shape. Additionally, the body 101 can include an upper side surface 106 which extends substantially along a vertical axis Y and is adjacent to the upper surface 112. In at least one example, the upper side surface 106 can be curved. In at least one example, the upper side surface 106 can extend in a direction that forms an angle relative to the vertical axis Y.

In at least one example, the body 101 can have a height H1 from the upper surface 112 to the lower surface 110 of about four inches to about eight inches. In some examples, the body 101 can have a height H1 of about 5 inches to about 7 inches. In some examples, the body 101 can have a height H1 of about 6 inches. Accordingly, the height H1 of the adaptor 100, and correspondingly the wellhead 11, is shortened to provide for safe access of the necessary valves.

In at least one example, as illustrated in FIGS. 2A-2C, the body 101 includes a protrusion 102 which extends radially from the body 101. The protrusion 102 can include an upper protrusion surface 104. The upper protrusion surface 104, as illustrated in FIGS. 2A and 2C, extends from the body 101 at an angle. In at least one example, the upper protrusion surface 104 can be curved, linear, perpendicular from the body 101, or any other suitable shape. The protrusion 102 and the protrusion surface 104 can be utilized to retain the adaptor 100 within the hub ring 28. For example, the protrusion 102 and the protrusion surface 104 can be received in the notch 202 of the hub ring 28 such that the protrusion surface 104 corresponds to and abuts the angled edge 204 of the hub ring 28 (as shown, for example, in FIG. 1B). Accordingly, the adaptor 100 can be retained within the wellhead 11 without the need of fasteners. Alternately or additionally, in other examples, fasteners such as nuts and bolts and/or screws can be utilized to couple the adaptor 100 with the hub ring 28. In some examples, the body 101 may not include a protrusion 102.

In at least one example, the upper surface 112 of the body 101 can include a beveled edge 108. The beveled edge 108 can extend from the upper surface 112 to the upper side surface 106 at an angle from both the upper surface 112 and the upper side surface 106. Accordingly, the beveled edge 108 is not perpendicular or aligned with either the upper surface 112 or the upper side surface 106. As illustrated in FIGS. 2A and 2C, the beveled edge 108 is substantially linear. In other examples, the beveled edge 108 can be curved such as concave or convex. In other examples, the upper surface 112 of the body 101 may not include a beveled edge 108.

As illustrated in FIGS. 2B and 2C, the upper surface 112 can include a recessed portion 130. The recessed portion 130 can be operable to receive the valve assembly 300 (for example as shown in FIG. 1B). In at least one example, the adaptor passage 132 can extend to the recessed portion 130 of the upper surface 112. As illustrated in FIG. 2B, the adaptor passage 132 is offset from the center of the adaptor 100. Additionally, the recessed portion 130 can be aligned with the adaptor passage 132, and accordingly, the recessed portion 130 can be offset from the center of the adaptor 100. In other examples, the recessed portion 130 can be centered on the upper surface 112. In yet other examples, the adaptor 100 may not include a recessed portion 130.

As illustrated in FIG. 2B, the recessed portion 130 can be substantially circular. In other examples, the recessed portion 130 can be substantially triangular, rectangular, oval, or any other suitable shape. The recessed portion 130 can include one or more coupling components 134. The coupling components 134 can be operable to couple the adaptor 100 with the valve assembly 300. In at least one example, the coupling components 134 can be positioned anywhere on the upper surface 112. In some examples as illustrated in FIG. 2B, the coupling components 134 can be positioned equidistantly around the adaptor passage 132.

As illustrated in FIG. 2C, the recessed portion 130 can have a bottom recess surface 131 that is substantially perpendicular to the vertical axis Y. In other examples, the bottom recess surface 131 can be irregular or have grooves so as to correspond to and receive the valve assembly 300. The recessed portion 130 can include side walls 136, 137 which extend substantially vertically from the bottom recess surface 131. In at least one example, the side walls 136, 137 can be inclined from the bottom recess surface 131 to a height H2 of about 0.5 inches to about 1.2 inches. In some examples, the side walls 136, 137 can be one consistent height H2 and is not inclined. Accordingly, the valve assembly 300 can be removed without having the unnecessarily raise the valve assembly 300 from the adaptor 100. Additionally, the side walls 136, 137 can retain the valve assembly 300 within the recessed portion 130 such that undesired lateral shifting of the valve assembly 300 is restricted.

In at least one example, as illustrated in FIG. 2C, the body 101 can form grooves 111 in the lower surface 110 which are operable to receive the seal ring 210. The seal ring 210 can prevent fluid from flowing across the seal ring 210 such that fluid does not leak through any potential gaps between the adaptor 100 and the ring 28.

As illustrated in FIG. 2C, the body 101 forms the adaptor passage 132 and the channel 120. The adaptor passage 132 extends along a vertical axis Y between the upper surface 112 and the lower surface 110. The adaptor passage 132 permits fluid to flow across the body 101 of the adaptor 100. The channel 120 extends between the upper surface 112 and the lower surface 110 and is operable to receive the cable 24 (as shown in FIG. 1B). The channel 120 extends in a direction A that forms an angle $\alpha$ relative to the vertical axis Y. As illustrated in FIG. 2C, the channel 120 extends in a direction A radially away from the adaptor passage 132. In at least one example, the channel 120 extends to the beveled edge 108. Accordingly, the cable 24 coupled with the electronic submersible pump 20 can extend from and/or into the adaptor 100 without bending the cable 24. In at least one example, the angle $\alpha$ relative to the vertical axis Y is between about 40 degrees and about 70 degrees. In some examples, the angle $\alpha$ relative to the vertical axis Y is between about 50 degrees and about 60 degrees. In some examples, the angle $\alpha$ relative to the vertical axis Y is about 55 degrees. The angle $\alpha$ of the channel 120 permits the cable 24 to extend from the adaptor 100 without interfering with the valve assembly 300. Accordingly, it is not necessary for the adaptor 100 to include a tall gooseneck, and the adaptor 100 is easier to machine and the height of the wellhead 11 is shortened.

Figure 3A:
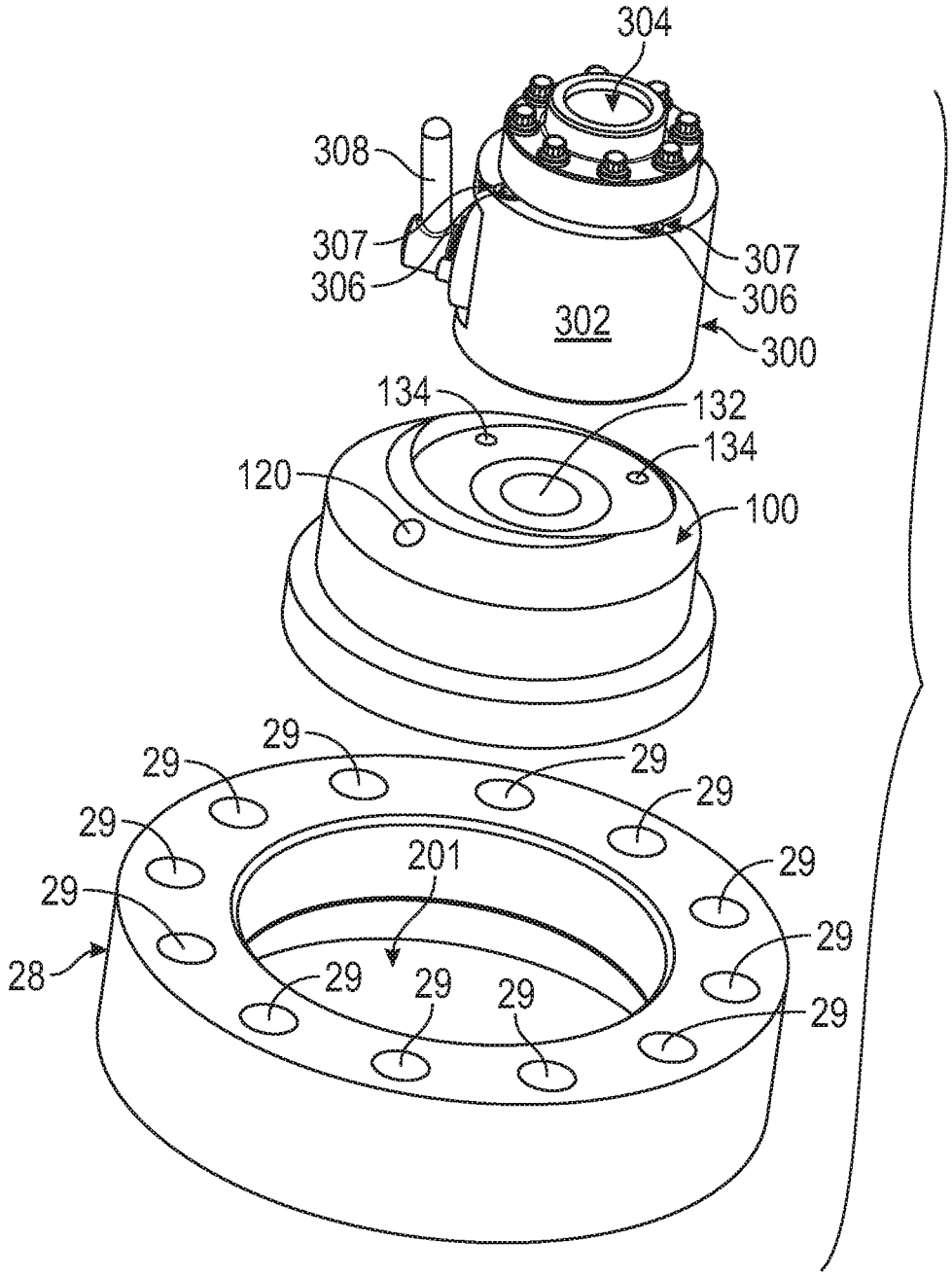
FIG. 3A is an exploded, isometric view of a wellhead.

FIGS. 3A-3D illustrate the adaptor 100 coupled with the hub ring 28 and the valve assembly 300. FIG. 3A illustrates an exploded view of the hub ring 28, the adaptor 100, and the valve assembly 300. As discussed above, the adaptor 100 can be received in opening 201 of the hub ring 28 and maintained in position by abutment fit. In other examples, the adaptor 100 can be coupled with the hub ring 28 by any suitable fasteners such as nuts and bolts, screws, or by threaded engagement. The valve assembly 300 is removably coupled with the adaptor 100 by one or more fasteners 306. As illustrated in FIG. 3A, the housing 302 can form fastener channels 307 which extend substantially along the vertical axis Y. The fasteners 306, as illustrated in FIG. 3A are bolts which are received in the fastener channels 307. The fasteners 306 are received in the coupling components 134 of the adaptor 100. In at least one example, the fasteners 306 and the coupling components 134 can include corresponding threads. The hub ring 28 includes fasteners 29, for example nuts and bolts, screws, and/or by threaded engagement, to removably couple the hub ring 28 with the joint 26 (as shown in FIG. 1B). As illustrated in FIG. 3A, the plurality of fasteners 29 is positioned around the perimeter of the hub ring 28.

Figure 3B:
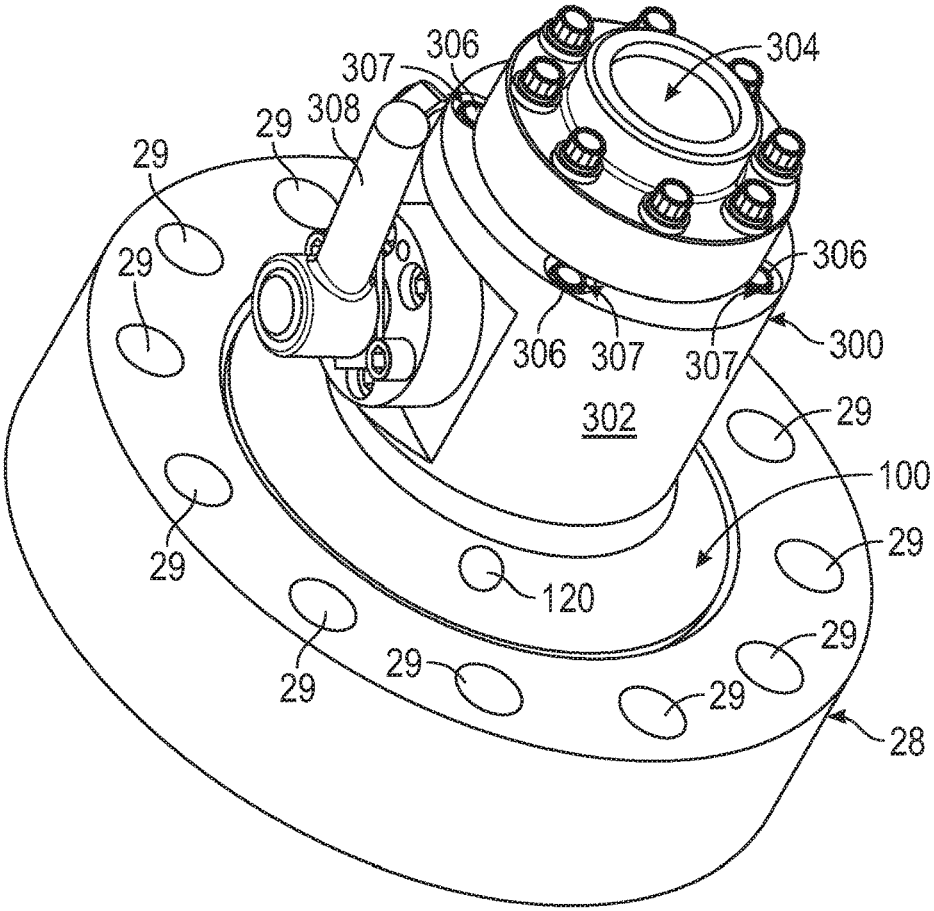
FIG. 3B is an isometric view of the wellhead of FIG. 3A.
Figure 3C:
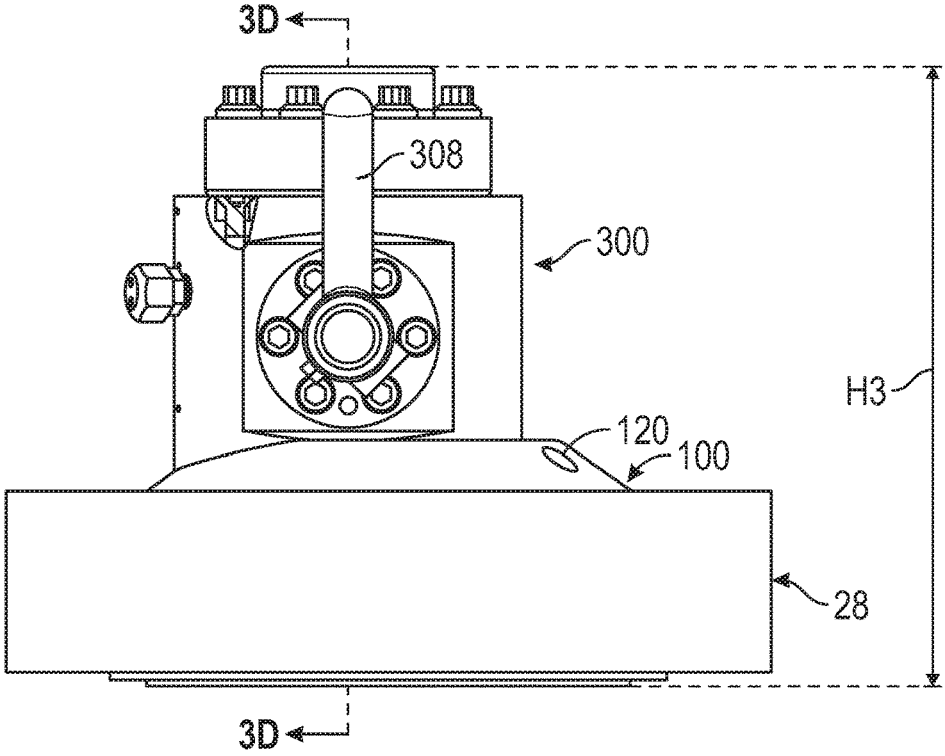
FIG. 3C is a side elevational view of the wellhead of FIG. 3A.

FIG. 3B illustrates an isometric, assembled view of the hub ring 28, the adaptor 100, and the valve assembly 300. FIG. 3C illustrates a side, assembled view of the hub ring 28, the adaptor 100, and the valve assembly 300. As shown in FIG. 3C, a combination of the housing 302 of the valve assembly 300 when coupled with the body 101 of the adaptor 100 can have a height H3 of about 13 inches to about 18 inches. In some examples, the height H3 of the combination can be about 14 inches to about 17 inches. In some examples, the height H3 of the combination can be about 15 inches to about 16 inches. Accordingly, the height of the wellhead 11 is decreased such that the users can comfortably and safely access the wellhead 11, for example to access valves and change components. In comparison, heights of conventional adaptors alone can be at least 18 inches.

Figure 3D:
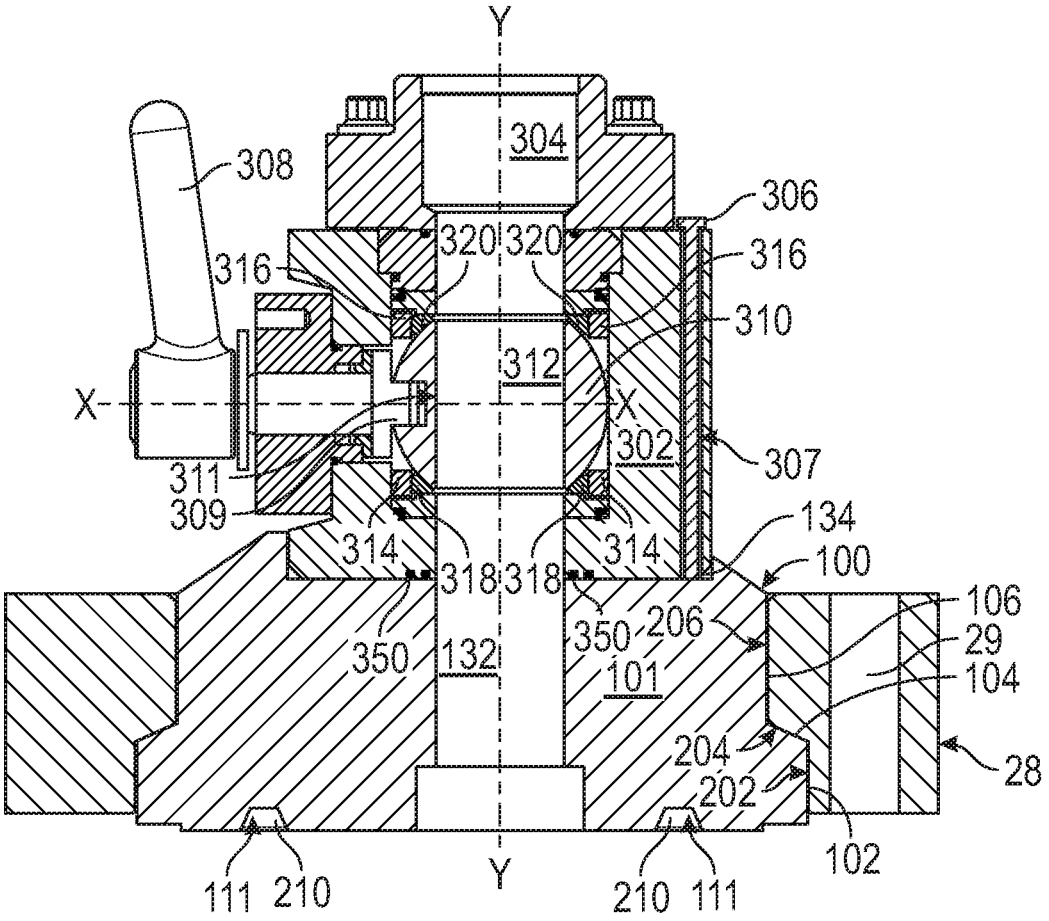
FIG. 3D is a cross-sectional view of the wellhead of FIG. 3B taken along line 3D-3D.

As illustrated in FIG. 3D, similar to FIG. 1B above, the hub ring 28 forms an opening 201 in which the adaptor 100 can be received. In other examples, the hub ring 28 does not include an opening 201 and is coupled with the adaptor 100, for example by fasteners. In yet other examples, a hub ring 28 may not be included. The hub ring 28 includes an inside wall 206 that forms the opening 201. As illustrated in FIG. 3D, the inside wall 206 can be substantially vertical. In other examples, the inside wall 206 can be angled and/or be irregularly shaped. The inside wall 206 forms a notch 202. The notch 202 is operable to receive a protrusion 102 of the adaptor 100 to couple the adaptor 100 with the hub ring 28 by abutment fit. Accordingly, the adaptor 100 can be retained within the hub ring 28, as the protrusion 102 of the adaptor 100, when received in the notch 202 of the hub ring 28, restricts the vertical movement of the adaptor 100, and the adaptor 100 cannot be released from the wellhead 11 without removing the hub ring 28. As illustrated in FIG. 3D, the notch 202 is positioned proximate the bottom of the hub ring 28, and the protrusion 102 is positioned proximate the lower surface 110 of the adaptor 100. In other examples, the notch 202 and corresponding protrusion 102 can be positioned at any suitable height and/or location.

The body 101 of the adaptor 100 forms the adaptor passage 132 which, received in the opening 201 of the hub ring 28 as illustrated in FIG. 3D, is in fluid communication with the valve passage 304, through which fluid can pass across the valve assembly 300, for example to a tree 30 and/or a flow line 36 (as shown in FIG. 1A). A seal ring 210 can be positioned between the bottom of the adaptor 100 and the joint 28. The seal ring 210 can prevent fluid from flowing across the seal ring 210 such that fluid does not leak through any potential gaps between the adaptor 100 and the ring 28. In some examples, the seal ring 210 may be positioned external the adaptor 100 and the ring 28. In at least one example, the seal ring 210 may be substantially circular. In other examples, seal ring 210 may be rectangular, triangular, ovoid, or any other suitable shape to create a seal between the adaptor 100 and the ring 28.

As illustrated in FIG. 3D, the valve assembly 300 includes a housing 302 which extends along the vertical axis Y. The housing 302 forms a valve passage 304 which also extends along the vertical axis Y. The valve assembly 300 can be coupled with the adaptor 100 such that the valve passage 304 is aligned with and in fluid communication with the adaptor passage 132. As illustrated in FIG. 3D, the valve passage 304 and the adaptor passage 132 may be substantially vertically aligned.

The valve 310 is positioned valve assembly 300 such that the valve 310 can transition between an open configuration to permit fluid communication across the valve 310 and a closed configuration to prevent fluid communication across the valve 310. In at least one example, a handle 308 can be actuated to transition the valve 310 between the open configuration and the closed configuration. For example, as illustrated in FIG. 3D, the valve assembly 300 is a ball valve assembly including a ball functioning as the valve 310. The ball 310 can be positioned within a cavity of the valve assembly 300. The ball 310 can form a flow passage 312 which spans across the ball 310. The ball 310 can be rotated within the cavity of the valve assembly 300 between an open configuration and a closed configuration. For example, a handle can be rotated or changed in position, and the ball 310 can be rotated to align the flow passage 312 with the valve passage 304 or rotated such that the flow passage 312 is not aligned with the valve passage 304. When the ball 310 is in the open configuration, the flow passage 312 is aligned with the valve passage 304 to permit fluid communication across the ball 310. When the ball 310 is in the closed configuration, the flow passage 312 is not aligned with the valve passage 304, and fluid communication across the ball 310 is prevented. When the ball 310 is in the closed configuration, an external surface of the ball 310 blocks the valve passage 304, and the fluid is prevented from flowing across the ball 310.

In at least one example, as illustrated in FIG. 3D, the ball 310 can include an engagement portion 311 which engages with a handle fastener 309 to couple the handle 308 with the ball 310. For example, the engagement portion 311 and the handle fastener 309 can be coupled by threaded engagement. When the handle 308 is turned, the ball 310 can be rotated within the cavity of the valve assembly 300 along a horizontal axis X which is transverse to the vertical axis Y. When the ball 310 is rotated along the horizontal axis X, the flow passage 312 is not aligned with the valve passage 304, and the ball 310 is transitioned to the closed configuration. As fluid pushing along one side of the ball 310 can cause a pressure differential to form across the ball 310. Accordingly, the ball 310 can experience a force in a direction along the vertical axis Y. The valve assembly 300 can include seats 318, 320 positioned on each side of the ball 310 along the vertical axis Y. In at least one example, the seats 318, 320 can be removable. The seats 318, 320 can maintain the position of the ball 310 as well as assist in absorbing the forces from the fluid. In at least one example, the valve assembly 300 can also include seat carriers 314, 316 coupled with the seats 318 320. In some examples, the seat carriers 314, 316 can be removable. The seat carriers 314, 316 can allow equalization of pressure around the seats 318, 320, reducing torque while opening the valve 310. The seat carriers 314, 316 can also allow for repair of the valve 310 even if minor erosion of the seat pocket occurs.

In other examples, other types of valves 310 can be utilized, for example check valves, butterfly valves, gate valves, globe valves, plug valves, and/or any other suitable types of valves.

In at least one example, for example as illustrated in FIG. 3D, one or more seals 350 can be positioned between the valve assembly 300 and the adaptor 100. The seals 350 can be, for example, o-ring seals. The seals 350 can prevent fluid from flowing across the seals 350 such that fluid does not leak through any potential gaps between the adaptor 100 and the valve assembly 300. In some examples, the seals 350 may be positioned external the adaptor 100 and the valve assembly 300. In at least one example, the seals 350 may be substantially circular. In other examples, seals 350 may be rectangular, triangular, ovoid, or any other suitable shape to create a seal between the adaptor 100 and the valve assembly 300.

Figure 4:
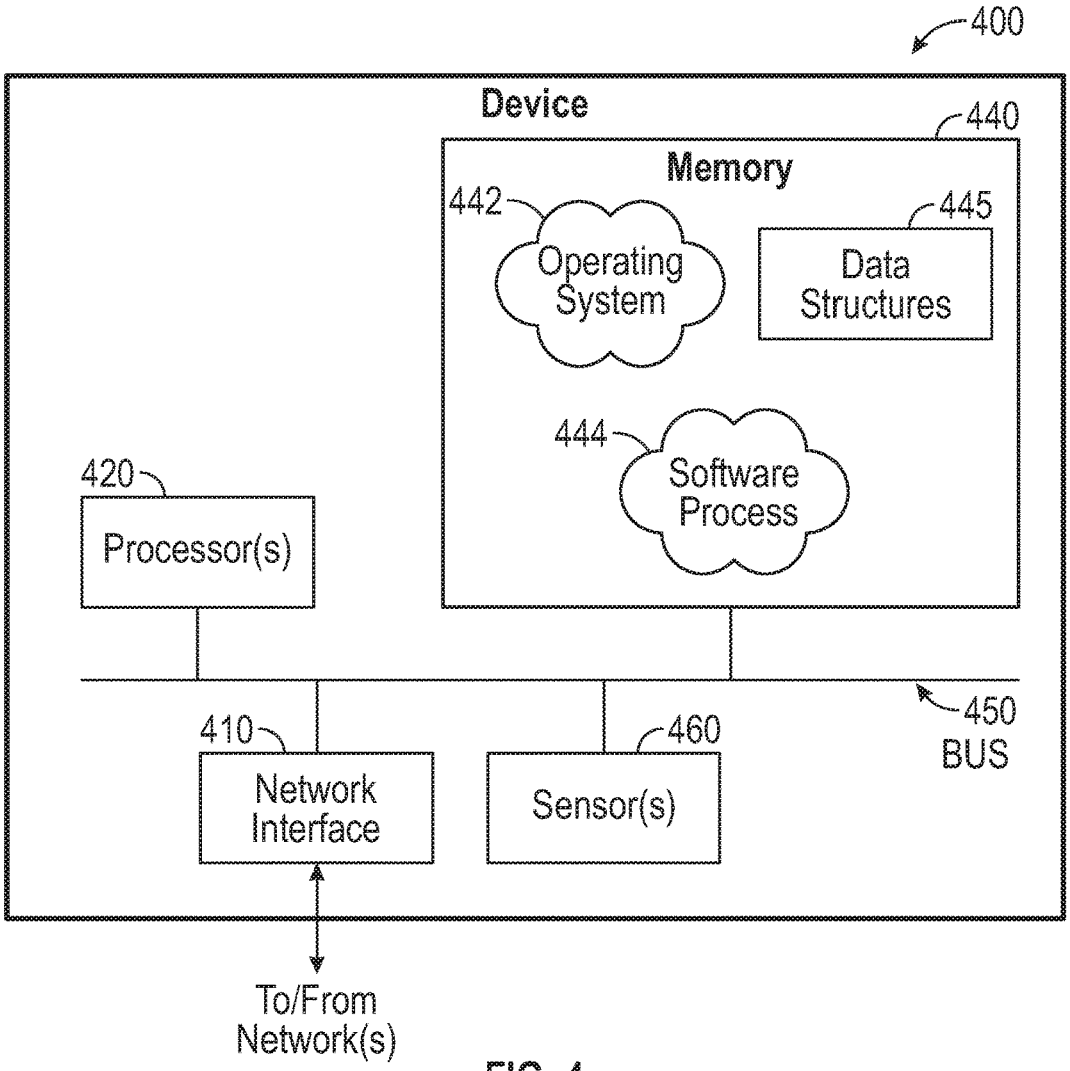
FIG. 4 is a diagram of a controller which may be employed as shown in FIG. 1A.

FIG. 4 is a block diagram of an exemplary controller 400. Controller 400 can be configured to perform processing of data and communicate with the ESP 20, for example as illustrated in FIG. 1A.

As shown, controller 400 includes hardware and software components such as network interfaces 410, at least one processor 420, sensors 460 and a memory 440 interconnected by a system bus 450. Network interface(s) 410 can include mechanical, electrical, and signaling circuitry for communicating data over communication links, which may include wired or wireless communication links. Network interfaces 410 are configured to transmit and/or receive data using a variety of different communication protocols, as will be understood by those skilled in the art.

Processor 420 represents a digital signal processor (e.g., a microprocessor, a microcontroller, or a fixed-logic processor, etc.) configured to execute instructions or logic to perform tasks in a wellbore environment. Processor 420 may include a general purpose processor, special-purpose processor (where software instructions are incorporated into the processor), a state machine, application specific integrated circuit (ASIC), a programmable gate array (PGA) including a field PGA, an individual component, a distributed group of processors, and the like. Processor 420 typically operates in conjunction with shared or dedicated hardware, including but not limited to, hardware capable of executing software and hardware. For example, processor 420 may include elements or logic adapted to execute software programs and manipulate data structures 445, which may reside in memory 440.

Sensors 460, which may include sensors of ESP 20 as disclosed herein, typically operate in conjunction with processor 420 to perform measurements, and can include special-purpose processors, detectors, transmitters, receivers, and the like. In this fashion, sensors 460 may include hardware/software for generating, transmitting, receiving, detection, logging, and/or sampling temperature, pressure, radiation levels, casing collar locations, weights, torques, tool health (such as voltage levels and current monitors), accelerations, gravitational fields, strains, video recordings, flow rates, solids concentration, solids size, chemical composition, and/or other parameters.

Memory 440 comprises a plurality of storage locations that are addressable by processor 420 for storing software programs and data structures 445 associated with the examples described herein. An operating system 442, portions of which may be typically resident in memory 440 and executed by processor 420, functionally organizes the device by, inter alia, invoking operations in support of software processes and/or services 444 executing on controller 400. These software processes and/or services 444 may perform processing of data and communication with controller 400, as described herein. Note that while process/service 444 is shown in centralized memory 440, some examples provide for these processes/services to be operated in a distributed computing network.

It will be apparent to those skilled in the art that other processor and memory types, including various computer-readable media, may be used to store and execute program instructions pertaining to the fluidic channel evaluation techniques described herein. Also, while the description illustrates various processes, it is expressly contemplated that various processes may be embodied as modules having portions of the process/service 444 encoded thereon. In this fashion, the program modules may be encoded in one or more tangible computer readable storage media for execution, such as with fixed logic or programmable logic (e.g., software/computer instructions executed by a processor, and any processor may be a programmable processor, programmable digital logic such as field programmable gate arrays or an ASIC that comprises fixed digital logic. In general, any process logic may be embodied in processor 420 or computer readable medium encoded with instructions for execution by processor 420 that, when executed by the processor, are operable to cause the processor to perform the functions described herein.

Referring to FIG. 5, a flowchart is presented. The method 500 is provided by way of example, as there are a variety of ways to carry out the method. The method 500 described below can be carried out using the configurations illustrated in FIGS. 1A-4, for example, and various elements of these figures are referenced in explaining example method 500. Each block shown in FIG. 5 represents one or more processes, methods or subroutines, carried out in the example method 500. Furthermore, the illustrated order of blocks is illustrative only and the order of the blocks can change according to the present disclosure. Additional blocks may be added or fewer blocks may be utilized, without departing from this disclosure. The example method 500 can begin at block 502.

At block 502, an adaptor passage is drilled in a body of an adaptor to extend substantially along a vertical axis between an upper surface and a lower surface. The adaptor passage can be drilled, for example, by a milling machine. The adaptor can be one piece of a metallic material. In at least one example, the adaptor can be steel. In some examples, the adaptor can be a cylindrical block. In other examples, the adaptor can be a rectangular block, an octagonal block, a hexagonal block, or any other suitable shape. In at least one example, the body can have a height from the upper surface to the lower surface of about four inches to about eight inches. In some examples, the body can have a height of about 5 inches to about 7 inches. In some examples, the body can have a height of about 6 inches.

At block 504, a channel can be drilled in the body of the adaptor. The channel can extend between the upper surface and the lower surface and can extend in a direction that forms an angle relative to the vertical axis. The channel can be drilled, for example, by a milling machine. In at least one example, the channel extends in a direction radially away from the adaptor passage. In at least one example, the angle relative to the vertical axis is between about 40 degrees and about 70 degrees. In some examples, the angle relative to the vertical axis is between about 50 degrees and about 60 degrees. In some examples, the angle relative to the vertical axis is about 55 degrees. The angle of the channel permits a cable to extend from the adaptor without interfering with a valve assembly, when the valve assembly is coupled with the adaptor. Accordingly, it is not necessary for the adaptor to include a tall gooseneck, and the adaptor is easier to machine and the height of the wellhead is shortened.

In at least one example, a protrusion can be formed in the body of the adaptor such that the protrusion extends radially from the body. The protrusion can be formed by machining a portion of the side of the body to form an upper side surface. In at least one example, the beveled edge can be machined by the use of a lathe. The upper side surface can have a width that is smaller than the protrusion. In at least one example, the width of the protrusion can be the original width of the body of the adaptor. In other examples, the protrusion can also be machined to form the desired shape and size.

The protrusion can be machined to form an upper protrusion surface. In at least one example, the upper protrusion surface can be formed by the use of a lathe. The upper protrusion surface can extend from the body at an angle. In at least one example, the upper protrusion surface can be curved, linear, perpendicular from the body, or any other suitable shape.

In at least one example, a beveled edge can be machined in the upper surface. In at least one example, the beveled edge can be machined by the use of a lathe. The beveled edge can extend from the upper surface to the upper side surface at an angle from both the upper surface and the upper side surface. Accordingly, the beveled edge is not perpendicular or aligned with either the upper surface or the upper side surface. In some examples, the beveled edge can be formed such that the channel extends to the beveled edge. Accordingly, the cable coupled with the electronic submersible pump can extend from and/or into the adaptor without bending the cable. In at least one example, the beveled edge can be substantially linear. In other examples, the beveled edge can be curved such as concave or convex. In other examples, the upper surface of the body may not include a beveled edge.

At block 506, a recessed portion can be cut into the upper surface. In at least one example, the recessed portion can be cut using a milling machine. In at least one example, the adaptor passage can extend to the recessed portion of the upper surface. In some examples, the adaptor passage can be offset from the center of the adaptor. Additionally, the recessed portion can be aligned with the adaptor passage, and accordingly, the recessed portion can be offset from the center of the adaptor. In other examples, the recessed portion can be centered on the upper surface. In such examples, the recessed portion may be formed using a lathe and/or a milling machine. In yet other examples, the adaptor may not include a recessed portion.

In at least one example, the recessed portion can be substantially circular. In other examples, the recessed portion can be substantially triangular, rectangular, ovoid, or any other suitable shape. The recessed portion can include one or more coupling components. The coupling components can be operable to couple the adaptor with the valve assembly. In at least one example, the coupling components can be positioned anywhere on the upper surface. In some examples, the coupling components can be positioned equidistantly around the adaptor passage.

The recessed portion can have a bottom recess surface that is substantially perpendicular to the vertical axis. In other examples, the bottom recess surface can be irregular or have grooves so as to correspond to and receive the valve assembly. The recessed portion can include side walls which extend substantially vertically from the bottom recess surface. The side walls can be inclined from the bottom recess surface to a height of about 0.5 inches to about 1.2 inches. Accordingly, the valve assembly can be removed without having the unnecessarily raise the valve assembly from the adaptor. Additionally, the side walls can retain the valve assembly within the recessed portion such that undesired lateral shifting of the valve assembly is restricted.

Numerous examples are provided herein to enhance understanding of the present disclosure. A specific set of statements are provided as follows.

Statement 1: An adaptor is disclosed for a system including an electric submersible pump, the adaptor comprising: a body including an upper surface and a lower surface opposite the upper surface, the body forming an adaptor passage and a channel; the adaptor passage extending along a vertical axis between the upper surface and the lower surface; the channel extending between the upper surface and the lower surface and operable to receive a cable coupled with the electronic submersible pump, the channel extending in a direction that forms an angle relative to the vertical axis; and the upper surface operable to receive a valve assembly forming a valve passage that aligns with the adaptor passage.

Statement 2: An adaptor is disclosed according to Statement 1, wherein the upper surface forms a recessed portion operable to receive a valve assembly forming a valve passage that aligns with the adaptor passage, the recessed portion having a bottom recess surface that is substantially perpendicular to the vertical axis.

Statement 3: An adaptor is disclosed according to Statement 2, wherein the recessed portion includes side walls extending substantially vertically from the bottom recess surface, the side walls are inclined from the bottom recess surface to a height of about 0.5 inches to about 1.2 inches.

Statement 4: An adaptor is disclosed according to any of preceding Statements 1-3, wherein the angle relative to the vertical axis is between about 40 degrees and about 70 degrees.

Statement 5: An adaptor is disclosed according to any of preceding Statements 1-4, wherein the upper surface includes a beveled edge, wherein the channel extends to the beveled edge.

Statement 6: An adaptor is disclosed according to any of preceding Statements 1-5, wherein the body is one piece of a metallic material.

Statement 7: An adaptor is disclosed according to any of preceding Statements 1-6, wherein the metallic material includes steel.

Statement 8: An adaptor is disclosed according to any of preceding Statements 1-7, wherein the body has a height of about four inches to about eight inches.

Statement 9: A system is disclosed comprising: a valve assembly including a housing extending along a vertical axis, wherein the housing forms a valve passage that extends along the vertical axis; and an adaptor removably coupled with the valve assembly, the adaptor including: a body including an upper surface and a lower surface opposite the upper surface, the body forming an adaptor passage and a channel; the adaptor passage extending along the vertical axis between the upper surface and the lower surface; the channel extending between the upper surface and the lower surface and operable to receive a cable coupled with an electronic submersible pump, the channel extending in a direction that forms an angle relative to the vertical axis; and the upper surface operable to receive the valve assembly such that the valve passage aligns with the adaptor passage.

Statement 10: A system is disclosed according to Statement 9, wherein the upper surface forms a recessed portion operable to receive a valve assembly forming a valve passage that aligns with the adaptor passage, the recessed portion having a bottom recess surface that is substantially perpendicular to the vertical axis.

Statement 11: A system is disclosed according to Statement 10, wherein the recessed portion includes side walls extending substantially vertically from the bottom recess surface, the side walls are inclined from the bottom recess surface to a height of about 0.5 inches to about 1.2 inches.

Statement 12: A system is disclosed according to any of preceding Statements 9-11, wherein a combination of the housing of the valve assembly coupled with the body of the adaptor has a height of about 13 inches to about 18 inches.

Statement 13: A system is disclosed according to any of preceding Statements 9-12, wherein the angle relative to the vertical axis is between about 40 degrees and about 70 degrees.

Statement 14: A system is disclosed according to any of preceding Statements 9-13, wherein the upper surface includes a beveled edge, wherein the channel extends to the beveled edge.

Statement 15: A system is disclosed according to any of preceding Statements 9-14, wherein the valve assembly includes a ball valve disposed in the housing, the ball valve forming a flow passage, wherein the valve assembly has (1) an open configuration such that the flow passage aligns with the valve passage to permit fluid communication across the ball valve and (2) a closed configuration such that fluid communication across the ball valve is prevented.

Statement 16: A system is disclosed according to any of preceding Statements 9-15, wherein the body of the adaptor is one piece of a metallic material.

Statement 17: A system is disclosed according to any of preceding Statements 9-16 wherein the metallic material includes steel.

Statement 18: A system is disclosed according to any of preceding Statements 9-17, wherein the body of the adaptor has an adaptor height of about four inches to about eight inches.

Statement 19: A method is disclosed comprising: drilling an adaptor passage in a body of an adaptor to extend along a vertical axis between an upper surface and a lower surface; and drilling a channel in the body of the adaptor, the channel extending between the upper surface and the lower surface and extending in a direction that forms an angle relative to the vertical axis.

Statement 20: A method is disclosed according to Statement 19, further comprising: cutting a recessed portion into the upper surface, the recessed portion having a bottom recess surface that is substantially perpendicular to the vertical axis.

Statement 21: A method is disclosed according to Statements 19 or 20, wherein the body is one piece of a metallic material.

Statement 22: A method is disclosed according to any of preceding Statements 19-21, wherein the body is one piece of a metallic material.

Statement 23: A method is disclosed according to any of preceding Statements 19-22, wherein the angle relative to the vertical axis is between about 40 degrees and about 70 degrees.

The disclosures shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the examples described above may be modified within the scope of the appended claims.

What is claimed is:

1. An adaptor for a system including an electronic submersible pump, the adaptor comprising:

a body including an upper surface and a lower surface opposite the upper surface, the body forming an adaptor passage and a channel;

the adaptor passage extending along a vertical axis between the upper surface and the lower surface;

the channel extending between the upper surface and the lower surface and operable to receive a cable coupled with the electronic submersible pump, the channel extending in a direction that forms an angle relative to the vertical axis; and the upper surface operable to receive a valve assembly forming a valve passage that aligns with the adaptor passage, wherein the upper surface forms a recessed portion operable to receive the valve assembly forming the valve passage that aligns with the adaptor passage, the recessed portion having a bottom recess surface that is substantially perpendicular to the vertical axis, wherein the recessed portion includes side walls extending substantially vertically from the bottom recess surface, a height of the side walls from the bottom recess surface is sloped between about 1.2 inches and about 0.5 inches.

2. The adaptor of claim 1, wherein the angle relative to the vertical axis is between about 40 degrees and about 70 degrees.

3. The adaptor of claim 1, wherein the upper surface includes a beveled edge, wherein the channel extends to the beveled edge.

4. The adaptor of claim 1, wherein the body is one piece of a metallic material.

5. The adaptor of claim 1, wherein the body has a height of about four inches to about eight inches.

6. A system comprising:

a valve assembly including a housing extending along a vertical axis, wherein the housing forms a valve passage that extends along the vertical axis; and an adaptor removably coupled with the valve assembly, the adaptor including:

a body including an upper surface and a lower surface opposite the upper surface, the body forming an adaptor passage and a channel;

the adaptor passage extending along a vertical axis between the upper surface and the lower surface;

the channel extending between the upper surface and the lower surface and operable to receive a cable coupled with an electronic submersible pump, the channel extending in a direction that forms an angle relative to the vertical axis; and the upper surface operable to receive the valve assembly such that the valve passage aligns with the adaptor passage, wherein the upper surface forms a recessed portion operable to receive the valve assembly forming the valve passage that aligns with the adaptor passage, the recessed portion having a bottom recess surface that is substantially perpendicular to the vertical axis, wherein the recessed portion includes side walls extending substantially vertically from the bottom recess surface, a height of the side walls from the bottom recess surface is sloped between about 1.2 inches and about 0.5 inches.

7. The system of claim 6, wherein a combination of the housing of the valve assembly coupled with the body of the adaptor has a height of about 13 inches to about 18 inches.

8. The system of claim 6, wherein the angle relative to the vertical axis is between about 40 degrees and about 70 degrees.

9. The system of claim 6, wherein the upper surface includes a beveled edge, wherein the channel extends to the beveled edge.

10. The system of claim 6, wherein the valve assembly includes a ball valve disposed in the housing, the ball valve forming a flow passage, wherein the valve assembly has (1) an open configuration such that the flow passage aligns with the valve passage to permit fluid communication across the ball valve and (2) a closed configuration such that fluid communication across the ball valve is prevented.

11. The system of claim 6, wherein the body of the adaptor is one piece of a metallic material.

12. The system of claim 6, wherein the body of the adaptor has an adaptor height of about four inches to about eight inches.

13. A method comprising:

drilling an adaptor passage in a body of an adaptor to extend along a vertical axis between an upper surface and a lower surface, the upper surface operable to receive a valve assembly forming a valve passage that aligns with the adapter passage; and drilling a channel in the body of the adaptor, the channel extending between the upper surface and the lower surface and operable to receive a cable coupled with an electronic submersible pump, the channel extending in a direction that forms an angle relative to the vertical axis; and cutting a recessed portion into the upper surface, the recessed portion operable to receive the valve assembly forming the valve passage that aligns with the adapter passage, the recessed portion having a bottom recess surface that is substantially perpendicular to the vertical axis, wherein the recessed portion includes side walls extending substantially vertically from the bottom recess surface, a height of the side walls from the bottom recess surface is sloped between about 1.2 inches and about 0.5 inches.

14. The method of claim 13, wherein the body is one piece of a metallic material.

15. The method of claim 13, wherein the angle relative to the vertical axis is between about 40 degrees and about 70 degrees.

* * * * *